US005479982A

United States Patent [19]

Höffken et al.

[11] Patent Number: 5,479,982

[45] Date of Patent: Jan. 2, 1996

[54] METHOD FOR THE PRODUCTION OF A STEEL STRIP BY THE CASTING OF A STRAND FOLLOWED BY ROLLING

[75] Inventors: Erich Höffken; Dieter Krüger, both of Dinslaken; Gisbert Mehring, Hattingen; Günter Pietzko, Essen, all of Germany

[73] Assignee: Thyssen Stahl Aktiengesellschaft, Duisburg, Germany

[21] Appl. No.: 164,008

[22] Filed: Dec. 8, 1993

[30] Foreign Application Priority Data

Dec. 23, 1992 [DE] Germany ..... 42 43 857.8

[51] Int. Cl.[6] ..... B22D 11/12; B22D 11/16

[52] U.S. Cl. ..... 164/454; 164/480; 164/154.2; 164/476

[58] Field of Search ..... 164/476, 454, 164/480, 428, 154.1, 54.2; 72/10, 12; 29/527.7

[56] References Cited

U.S. PATENT DOCUMENTS 3,491,562 1/1970 Kajiwara .

4,649,986 3/1987 Frischknecht ..... 164/480

FOREIGN PATENT DOCUMENTS 0286862 10/1988 European Pat. Off. .

037087 3/1986 Japan .

8800101 1/1988 WIPO .

*Primary Examiner*—P. Austin Bradley

*Assistant Examiner*—Randy Hernick

*Attorney, Agent, or Firm*—Meltzer, Lippe, Goldstein et al.

[57] ABSTRACT

A method for producing a steel strip which has been cast as a stand in a cooled oscillating continuous chill mould, comprises squeezing the strand emerging from the chill mould until it has a first cross-sectional thickness (40–50 mm), followed by hot rolling the strand until it has a second cross-sectional thickness (2–25 mm). Deviations in the normal path of travel of the strand following hot rolling are corrected by adjusting the thickness to which the strand is subjected during the first squeezing step.

7 Claims, 2 Drawing Sheets

METHOD FOR THE PRODUCTION OF A STEEL STRIP BY THE CASTING OF A STRAND FOLLOWED BY ROLLING

BACKGROUND OF THE INVENTION

The invention relates to a method for the production of a steel strip, more particularly, a steel strip having a thickness of 2–25 mm, wherein a strand is cast in a cooled oscillating continuous chill mould, the strand leaving the continuous chill mould with solidified strand shells and liquid core is squeezed together, more particularly, to a thickness of 40–50 mm at least until the strand shells are welded, and then the strand is hot rolled in the casting heat to a thickness of 2–25 mm.

Thin steel strips of high quality can be produced comparatively inexpensively by such a method, as shown from EP 0286862 A1. In that method, squeezing together is performed by a pair of squeezing rolls disposed immediately downstream of the chill mould. Thereafter the strand is rolled down with a degree of deformation of 5–85% to the strip thickness of 2–25 mm.

In that method, due to the different heat transfers during the cooling of the strand in the continuous chill mould, strand shells of locally different thicknesses may be formed. If such a strand is squeezed together by the squeezing rolls disposed downstream of the chill mould until the strand shells have become welded, a strand may be produced which has across its width not only different temperatures, but also different thicknesses and structures. These local differences across the strand width lead to different deformation resistances of the material, so that when rolling-down is performed by the squeezing rolls, because of fibres of different length, the strip emerging from the roll nip appears wavy in the longitudinal direction, when viewed over the width. If the material has different lengths at the opposite strip edges, the result is that the strip takes on a cambered course—i.e., deviates from a straight run-out. Strips which deviate from a straight run-out cause processing difficulties in the connected processing units, such as high deformation roll stands and coilers.

To control the straight run-out of rolled strips., it is known from U.S. Pat. No. 3,491,562 to determine the deviation of strip running from a straight run-out downstream of a roll stand and, in case of deviation, to adjust the nip section of the preceding roll stand in the sense of a correction of strip running. This correction of strip running inevitably results in an alteration of the thickness of the strip across its width. When a strip having a low degree of deformation is rolled, the different strip thickness may be acceptable; but with substantially higher degrees of deformation, up to 85%, this kind of correction of strip running would cause unacceptable differences in thickness across the strip width, more particularly, because the connected high deformation rolls require a given strip run-in cross-section. This way of correcting strip running is therefore unsuitable for a method of the kind specified initially.

SUMMARY OF THE INVENTION

The invention relates to the problem of enabling strip running to be corrected in a method of the kind specified initially for the production of a steel strip.

This problem is solved in a method of the kind specified by the feature that with a given roll nip across the strip width, the running path of the hot rolled strip is corrected in case of deviation from a straight run-out by altering the cross-section of the strand during the preceding squeezing together step.

In contrast with the prior art, in the method according to the invention, action is taken not in the immediate deforming unit which determines the given strip cross-section and downstream of which any skewed running is detected, but in the preceding deforming unit. This is advantageous, on the one hand because such intervention does not change the given strip cross-section, and on the other hand the action can be taken with comparatively low deforming forces in the preceding deforming unit—i.e., at the place where the strand is first squeezed together. The invention is based on the idea that all that is required for the correction of the strip running path is to change the cross-section in the preceding deforming unit producing the strip. It is immaterial whether this results in a skewed strip running path in the zone between the initial squeezing together of the strand and the final rolling-down process, since in the long run the main point is that after rolling-down, the strip runs straight and has across its whole width the given cross-section required for further processing.

During initial squeezing together, the cross-sectional thickness of the strand can be very precisely adjusted within certain limits and without great expenditure of force, since at that point the strand still has a liquid core and also the inner sides of the shell are still pasty. To obtain a homogeneous strand which is dense at all points, as is important for the adjustment to a predetermined thickness section across the entire strip width during rolling and for the purpose of straight band running, the following marginal condition should be maintained:

$$2\ SD-3\ mm<QS<2\times SD-0.55\ mm$$

where SD is the thickness of the strand shell on reaching the squeezing zone and QS is the thickness of the strand.

The strand emerging from the chill mould is preferably squeezed together by at least one pair of driven rolls. To prevent impermissibly high tensile forces from acting on the strand, while at the same time preventing the strand from running askew due to slag across the strand width which may cause the squeezing rolls to apply different squeezing forces at the two edges of the strip, according to one feature of the invention, the following marginal condition is maintained for the torque (M) of the squeezing rolls:

$$0.2\times DQ\times QK\leqq M\leqq 1.2\ DQ\times QK$$

where DQ is the diameter of the squeezing rolls and QK is the squeezing force. Satisfactory results have been obtained with a squeezing roll diameter DQ=200–500 mm. A squeezing force QK=50–600 kN is adequate for the welding of the strand shell and for the required density of structure.

If the strand is squeezed together in a number of steps, according to another feature of the invention, the adjustment of the strand cross-section for correcting the strip running path is performed at the last squeezing rolls.

There are several possible ways of determining the deviation between the required and actual values of running path of the hot rolled strip. The strip edges can be determined by means of conventional measuring units, such as rolls which feel the strip edges or contactless devices, such as inductive feelers, or laser distance measuring devices. To maintain a short adjusting time, the measuring location should be as close as possible to the location of hot rolling. However, it must be far enough away from the location of hot rolling for any deviation to be determined using simple technical measuring means. Particularly advantageously, the positions of the strip edges are determined in a number of succeeding locations lying on behind the other in the strip running direction. If the strip is guided in an arc, strip running can also be determined by determining the radius of the arc at both strip edges. The measuring method is based on the knowledge that the strip is firmly clamped upstream and downstream of the arc, but is freely guided therebetween, so that different arc radii result in accordance with the different strip edge lengths which are responsible for the skewed running.

The correction of a strip running askew results in different nip widths for the two edges of the strand in the squeezing roll nip during the squeezing together step.

To adjust strip running downstream of the roll stand, according to the invention the nip of the squeezing rolls disposed upstream of the roll stand is adjusted, so that the nip takes on different values at the right-hand and left-hand edges. It has now been found that when an extremely asymmetrical squeezing roller nip is adjusted, the position of the strand between the squeezing rolls and the chill mould outlet end can also be influenced, even if the drive of the squeezing rolls prevents the rolls from slipping. This effect may also influence the strand still in the chill mould. The strand may become tilted in the chill mould, so that the strand shell is lifted off more particularly from the walls of the narrow sides of the mould. In that case the lifting of the strand shell off the mould wall leads to a poor one-sided heat transfer between the shell and the wall and therefore to an uneven growth of the lifted-off shell. In extreme cases this may cause the rupture of the strand. However, as a rule the only result is an uneven heat distribution in the shell and therefore an irregular shell thickness. To obviate these disadvantages and obtain a strand of uniform structure, according to the invention, superimposed on the control of the squeezing rollers, which take place in dependence on the position of the strip measured downstream of the roll stand, is a second control of the temperature in the chill mould which is performed in dependence on the temperature or heat flux density of the narrow sides of the chill mould. This temperature-dependent control ensures an even shell growth, something which is of decisive importance for the adjustment of a dense strand with a temperature uniform over its width. According to the invention the heat flux density measured in the narrow sides is adjusted to between 500 and 1500 $kW/m^2$. If a heat flux density of 500 $kW/m^2$ is not reached, there is the risk that the strand shell will rupture, so that casting must be temporarily interrupted if such a value occurs.

BRIEF DESCRIPTION OF THE DRAWING

The invention will now be described in greater detail with reference to FIGS. 1 and 2 which are diagrammatic side elevational views of an installation for the production of a strip in accordance with the present invention.

DETAILED DESCRIPTION OF THE INVENTION

Figure 1:
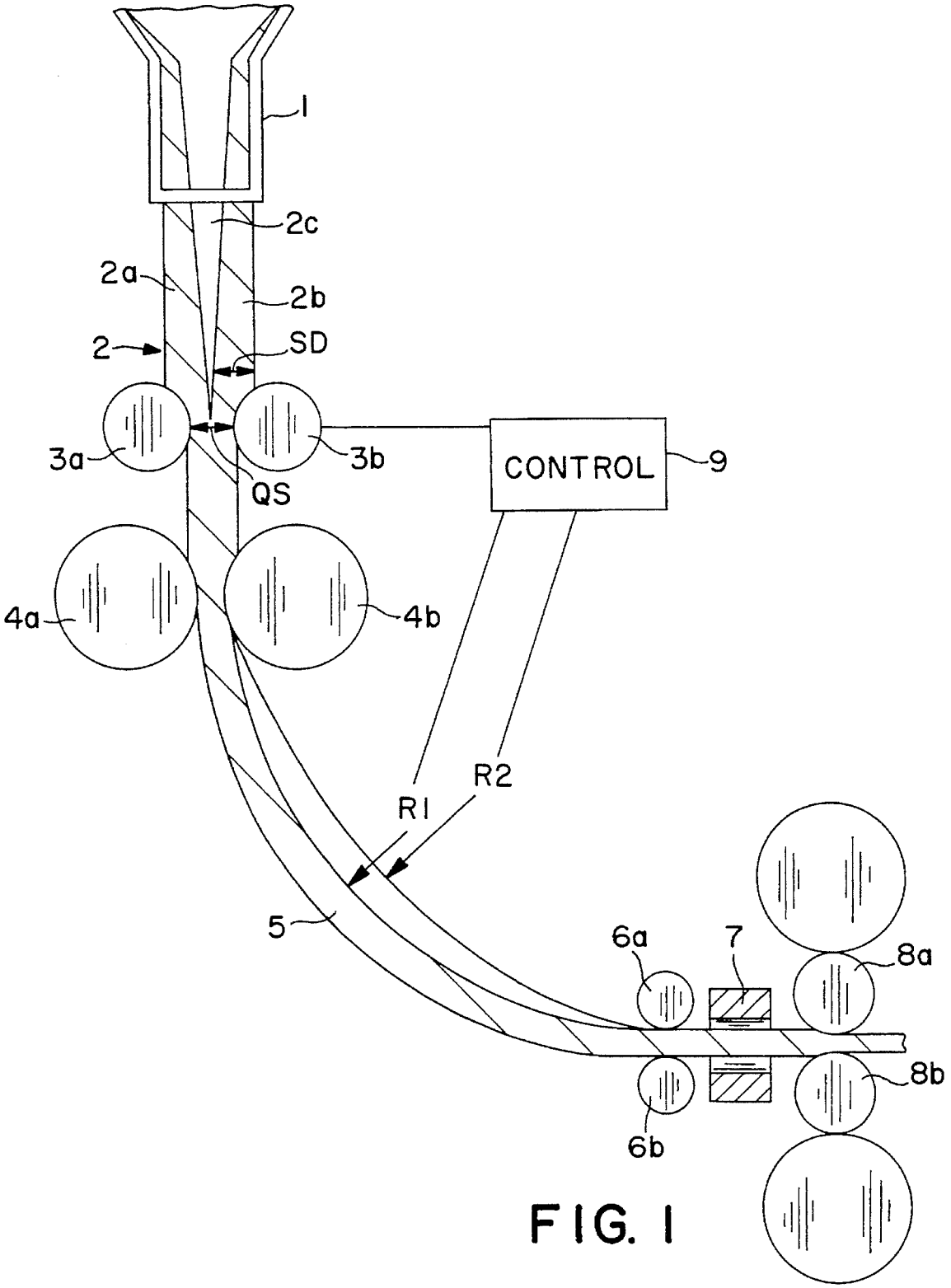

The installation of FIG. 1 comprises an oscillating continuous chill mould 1 having cooled walls. A strand 2 with a solidified strand shells 2*a*, 2*b* and a liquid core 2*c* emerges from the chill mould 1. The strand 2 is squeezed together between a pair of squeezing rolls 3*a*, 3*b* to such an extent that the strand shells 2*a*, 2*b*, which each has a thickness SD in the run-in zone to the pair of squeezing rolls 3*a*, 3*b*, are welded to one another at least along their inside walls. From the squeezing rolls 3*a*, 3*b*, the strand 2 passes to a roll stand having two rolls 4*a*, 4*b*, which give an emerging strip 5 a given cross-sectional thickness across the entire strip width. The strip 5 is freely guided in an arc and possibly guided over guide rolls 6*a*, 6*b* through a furnace 7 to compensate for temperature losses and further reshaped by one or more high deformation stands 8*a*, 8*b*.

Such an installation (but without furnace 7) is known in the prior art (EP 0286862 A1). With this installation a steel strip 5 can be produced with a thickness of up to 2 mm. The steel strand 2 is drawn in a thickness of 40–50 mm from mould 1 at a speed of 2–20 m/min. Between the squeezing rolls 3*a*, 3*b* it is squeezed together to below 30 mm, more particularly, to 10–25 mm. In roll stand 4*a*, 4*b* it is rolled down to the final dimension of 2–25 mm thickness with a degree of deformation of $\leqq 20\%$, but preferably 30%.

The special feature of the installation according to the invention is that strip running is measured—i.e., a check is made on whether the strip 5 is running askew—downstream of the roll stand 4*a*, 4*b* in the direction of strip running.

In the illustrated example, the measurement is performed by control unit 9 via the radii of curvature $R_1$, $R_2$ of the two strip edges or via measurement of the distance of the strip edges from fixed location disposed at an equal distance with the strip in its required position. In dependence on this measuring result, an adjustment is made by control unit 9 to the squeezing rolls 3*a*, 3*b*, the distance between one of the ends thereof being increased or reduced as required by the correction of strip running. However, the following limit condition is maintained between squeezing rolls 3*a*, 3*b*: 2 SD–3 mm <QS<2 SD–0.5 mm (SD=thickness of the strand shell 2*a* and 2*b* respectively; QS=distance between the squeezing rolls 3*a*, 3*b*).

This adjustment of strip running makes use of the knowledge that during the rolling of a steel strand, the alteration in length of the rolled strip depends inter alia on the strand thickness upstream of the roll nip, in the sense that an increase in the amount of material to be deformed upstream of the roll nip leads to a lengthening of the corresponding zone of the rolled strip. When applied to the example, this means that the material available for the edge with radius $R_1$ must be reduced—i.e., the distance between the squeezing rolls 3*a*, 3*b* on the side associated with said edge must be reduced, while the material available for the strip edge with radius $R_2$—i.e., the distance between the squeezing rolls 3*a*, 3*b* on the side associated with said strip edge—must be increased.

Figure 2:
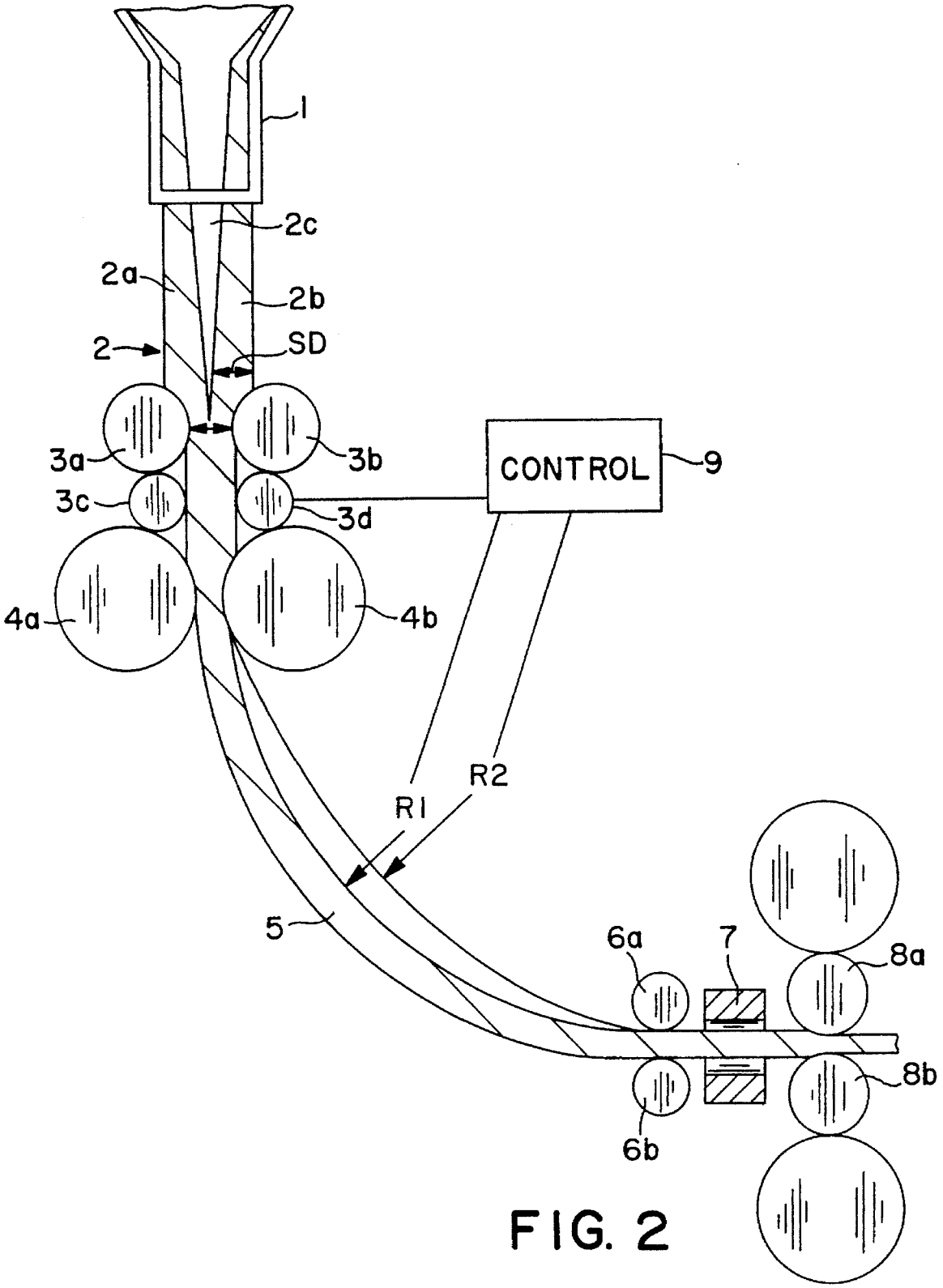

FIG. 2 illustrates an installation which is similar to that of FIG. 1 except that there are two pairs of squeezing rolls, 3*a*, 3*b* and 3*c*, 3*d* in the installation. Control unit 9 adjusts the strand cross-section for correcting the strip running path at the second pair of squeezing rolls 3*c*, 3*d*.

We claim:

1. A method for producing a steel strip which has been cast as a strand in a cooled oscillating continuous chill mould, said strand having solidified strand shells and a liquid core as it leaves said continuous chill mould, comprising squeezing said strand emerging from said continuous chill mould until said strand shells are welded together and said strand has a first cross-sectional thickness, hot rolling said strand to a second cross-sectional thickness, detecting whether there are any deviations in the normal path of travel of the strand following said hot rolling, and correcting said deviations by changing said first cross-sectional thickness during said squeezing step.

2. The method of claim 1 wherein said first cross-sectional thickness is in the range of 40–50 mm and said second cross-sectional thickness is in the range of 2–25 mm.

3. The method of claim 2 wherein during said squeezing step, the following marginal condition is maintained:

$$2\ SD-3\ mm<QS<2\ SD-0.5\ \text{mm}$$

wherein SD is the thickness of each of said strand shells and QS is said first cross-sectional thickness.

4. The method of claim 1 wherein said strand is squeezed by means of a first set of squeezing rolls and during said squeezing step, the following marginal condition is maintained:

$$0.2\times DQ\times QK\leqq M\leqq 1.2\times DQ\times QK$$

where M is the torque applied by said squeezing rolls, QK is the squeezing force applied by said squeezing rolls, and DQ is the diameter of each of said squeezing rolls.

5. The method of claim 1 wherein strand is squeezed by a plurality of pairs of squeezing rolls and said deviations are corrected by changing said first cross-sectional thickness by means of a last pair of said squeezing rolls.

6. The method of claim 1 wherein said deviations from said normal path of travel are detected in at least one plane lying immediately downstream of said hot rolling step.

7. The method of claim 1 wherein said normal path of travel includes an arc following hot rolling wherein said strand is freely guided, and wherein said deviations are detected by determining radii $R_1$ and $R_2$ of said arc at the opposite edges of strand.

* * * * *